US006095223A

United States Patent [19]

Rossini et al.

[11] Patent Number: 6,095,223

[45] Date of Patent: Aug. 1, 2000

[54] ACTUATION UNIT FOR VENETIAN BLINDS OR THE LIKE

[76] Inventors: Mauro Rossini, Viale Fiume, 5, 35042 Este (Prov. of Padova); Vanni Gallocchio, Vicolo S. Mauro, 3, 35036 Montegrotto Terme, both of Italy

[21] Appl. No.: 09/032,754

[22] Filed: Feb. 27, 1998

[30] Foreign Application Priority Data

Mar. 3, 1997 [IT] Italy ..... PD97A0040
Oct. 6, 1997 [IT] Italy ..... PD97A0219

[51] Int. Cl.[7] ..... E06B 9/264

[52] U.S. Cl. ..... 160/107; 160/168.1 P; 475/149

[58] Field of Search ..... 160/168.1 P, 176.1 P, 160/107, 310, 311, DIG. 17; 74/DIG. 4; 310/83, 103, 75 D; 475/149

[56] References Cited

U.S. PATENT DOCUMENTS

| | | | |
|---|---|---|---|
| 3,240,304 | 3/1966 | Wickersham | 310/103 X |
| 3,523,204 | 8/1970 | Rand | 310/103 X |
| 3,864,587 | 2/1975 | Landry . | |
| 4,079,597 | 3/1978 | Lindner et al. | 475/149 X |
| 4,096,903 | 6/1978 | Ringle | 160/107 X |
| 4,100,441 | 7/1978 | Landry . | |
| 4,417,185 | 11/1983 | Bullat | 160/310 X |
| 4,979,552 | 12/1990 | Zanden | 160/107 |
| 5,013,949 | 5/1991 | Mabe | 310/83 |
| 5,078,665 | 1/1992 | Castellani | 475/342 |
| 5,447,477 | 9/1995 | Bresson et al. | 160/310 X |

FOREIGN PATENT DOCUMENTS

| | | |
|---|---|---|
| 29 21 608 | 12/1980 | Germany . |
| 95 24539 | 9/1995 | WIPO . |

*Primary Examiner*—David M. Purol

[57] ABSTRACT

An actuation unit for a Venetian blind accommodated in a double-glazing unit or fixed to a window and movable between a fully packed or rolled-up condition and an opened-out condition. The actuation unit includes a magnetic kinematic coupling device which is connected with a device for generating a rotary motion and with kinematic systems for moving the Venetian blind. The magnetic kinematic coupling device has a first permanent cylindrical magnet which is connected so as to rotate with a shaft of the device for generating a rotary motion, and a plurality of second permanent magnets arranged about the first magnet. The second magnets have a polarization extending parallel and similar to that of the first magnet such that the second magnets rotate in relation to the rotation of the first magnet in response to a closure of radial field lines.

15 Claims, 4 Drawing Sheets

ACTUATION UNIT FOR VENETIAN BLINDS OR THE LIKE

BACKGROUND OF THE INVENTION

The present invention relates to an actuation unit articularly for Venetian blinds or the like.

Currently available double-glazing units are particularly appreciated for their functional properties in terms of heat and sound insulation.

Double-glazing units, in particular, are casements comprising a perimetric frame which supports two parallel panes which are at least partially transparent to light and form, between them, a hermetic air space which contains light blocking means (Venetian blinds, pleated curtains, or the like) which are moved from a fully packed or rolled-up condition to an opened-out condition suitable to provide the light blocking, and viceversa, by motor means associated with the frame.

In particular, the air space between the two panes is hermetic, so as to enhance the heat and sound insulation qualities.

Blocking means, such as shutters, roll-up blinds, Venetian blinds or other equivalent means, can also be accommodated within said air space.

One of the main problems of double-glazing units is to transmit the motion of the motor means to the kinematic systems for moving the blocking means without compromising the hermetic seal of the frame of said double-glazing unit.

Electromagnetic couplings have been conceived for this purpose which are arranged partly inside the double-glazing unit and partly outside it and are substantially constituted by two facing shaft sections which support mushroom-like expansions constituted by disk-like permanent magnets.

In particular, the magnets face each other in the active condition, so as to close axial magnetic field lines.

The electromagnetic couplings, although solving the problem of hermetic sealing, are not free from drawbacks.

First of all, the forces produced by the magnetic field and by the intrinsic structure of the couplings forces them to require, at the ends of the shaft sections, thrust bearings which further complicate the general structure, which in any case must be installed inside the frame of the double-glazing unit, which usually has small dimensions and therefore a limited containment capacity.

It is also known that the force transmitted by the magnetic couplings varies proportionally to the facing surface which is perpendicular to the closed field lines; accordingly, it is evident that in order to increase the force that can be transmitted by the coupling it is necessary to provide magnets having larger radial dimensions.

On the other hand, the seats of the magnets are scarcely able to cope with radial increases in their dimensions, since they indeed have a mainly longitudinal extension.

It is also known that Venetian blinds, to be applied to windows or at door-windows of balconies, are currently also widely used.

Obviously, Venetian blinds and all similar blinds are fixed at the inner face of the window.

If a building is provided with double glazing, which is particularly appreciated owing to its functional properties in terms of heat and sound insulation and is constituted by a first external window, fitted on the exposed face of the building, and by a second inner window, the blinds are preferably arranged in the air space formed between the windows.

Venetian blinds, pleated blinds, shutters and all other similar blinds are light blocking means which must be actuated for movement from a fully packed or rolled-up condition to an opened-out condition.

Currently there is a tendency in the market to prefer motorized actuation systems for blinds, particularly for structures such as offices, hospitals, shopping centers, and if it is necessary to move armored shutters, since they are very heavy.

One of the main problems observed, however, is the transmission of the movement of the motor to the kinematic system for moving the blind so as to contain the bulk.

Moreover, the actuation unit should have a simple and functional structure so as to allow to replace the motor if necessary.

The motor in fact tends to break and malfunction and may require maintenance.

Up to now it has been necessary for a specialized person to act directly to disassemble the motor from the kinematic system and, once the motor has been repaired or replaced, to reinstall it and restore its connection to the kinematic system, with evident complexity in maneuvering and with a great waste of time.

SUMMARY OF THE INVENTION

The aim of the present invention is to provide an actuation unit for Venetian blinds or the like which solves the drawbacks mentioned above of conventional actuation units.

Within the scope of this aim, an object of the present invention is to provide an actuation unit for Venetian blinds or the like in double-glazing units which is balanced from the mechanical point of view and for which it is not necessary to apply thrust bearings or other auxiliary balancing structures.

Another object of the present invention is to provide an actuation unit which can be easily accommodated in the structure of a double-glazing unit.

Another object of the present invention is to provide an actuation unit in which it is possible to increase the force that can be transmitted without however requiring significant and demanding increases in the containment capacity of the seat formed in the structure of the double-glazing unit.

Another object of the present invention is to provide an actuation unit which is particularly adaptable to various double-glazing units.

Another important object of the present invention is to provide an actuation unit which is compact and can optionally be easily accommodated within a covering structure.

Another object of the present invention is to provide an actuation unit which has a compact structure and allows easy replacement or repair of the motor if necessary.

Another object of the present invention is to provide an actuation unit which can be particularly adapted to all blinds and windows.

Another object of the present invention is to provide an actuation unit which can be manufactured with known technologies.

This aim, these objects and others which will become apparent hereinafter are achieved by an actuation unit for light blocking means which are accommodated in a double-glazing unit or are fixed to a window and are suitable to be moved from a fully packed or rolled-up condition to an opened-out condition and viceversa, characterized in that it comprises a magnetic kinematic coupling device which is associated with means for generating a rotary motion and with kinematic systems for moving said blocking means, said device being constituted by at least one first permanent magnet which is connected so as to rotate with a shaft of said motor means, and at least one second permanent magnet, whose polarization is parallel and similar to that of the first magnet and which is suitable to rotate in relation to the rotation of said central magnet by virtue of the closure of radial field lines.

BRIEF DESCRIPTION OF THE DRAWINGS

Further characteristics and advantages of the actuation unit according to the present invention will become apparent from the following detailed description of embodiments thereof, illustrated only by way of non-limitative example in the accompanying drawings, wherein.

DESCRIPTION OF THE PREFERRED EMBODIMENTS

Figure 1:
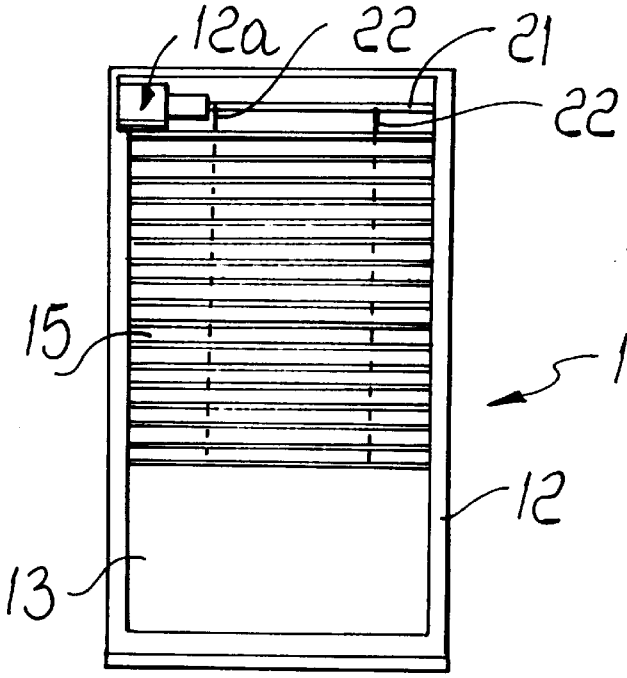
FIG. 1 is a front view of a double-glazing unit provided with a Venetian blind which is actuated by a unit according to the invention in a first embodiment.
Figure 2:
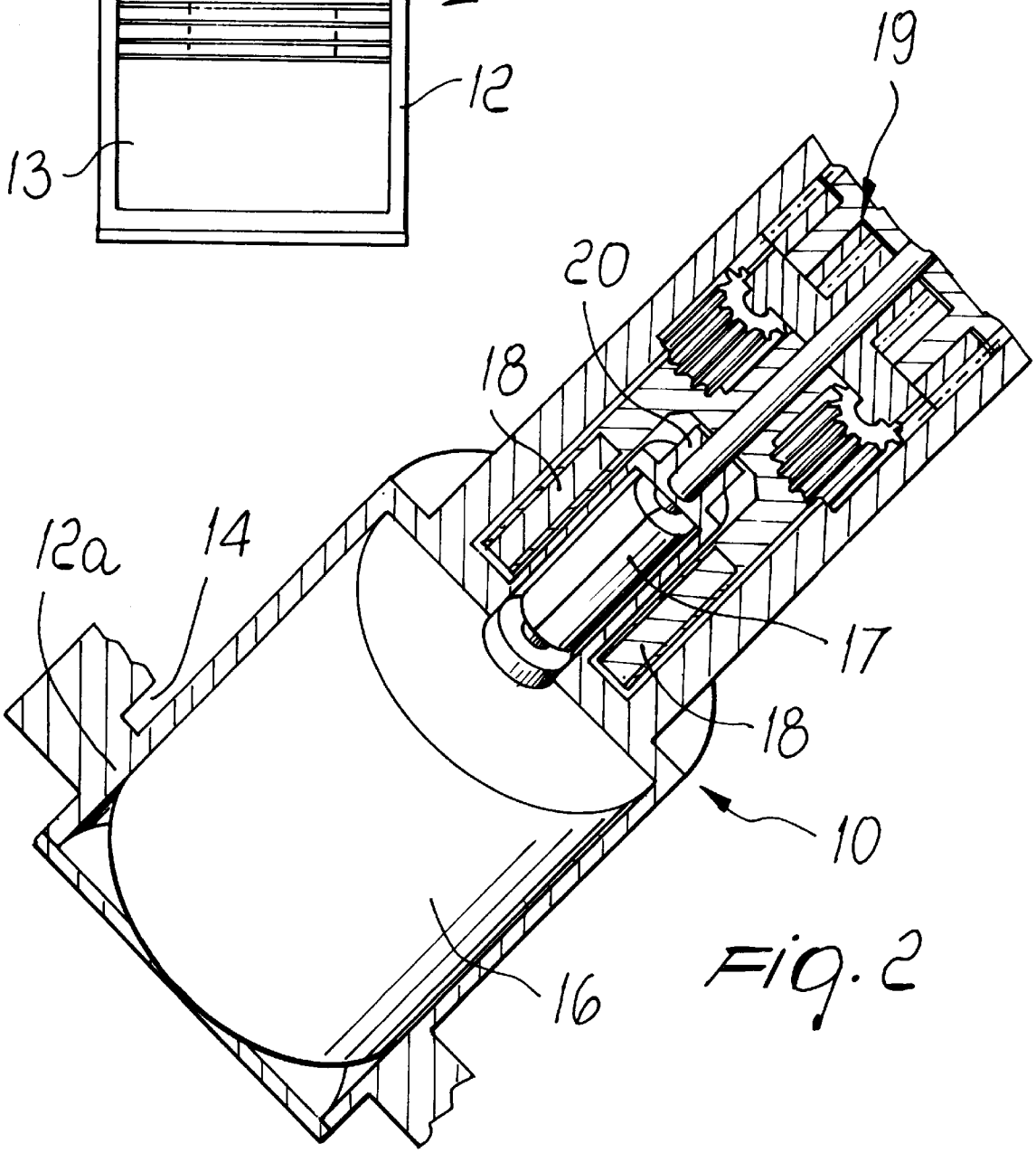
FIG. 2 is a perspective cutout view of a detail of the unit of FIG. 1.
Figure 4:
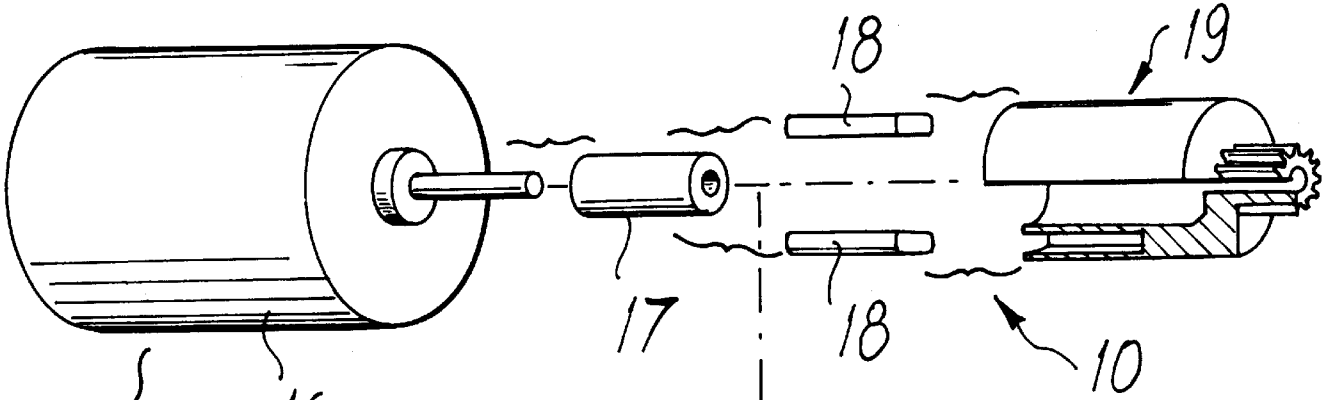
FIG. 4 is a sectional orthographic projection view of the detail of FIG. 2.
Figure 4:
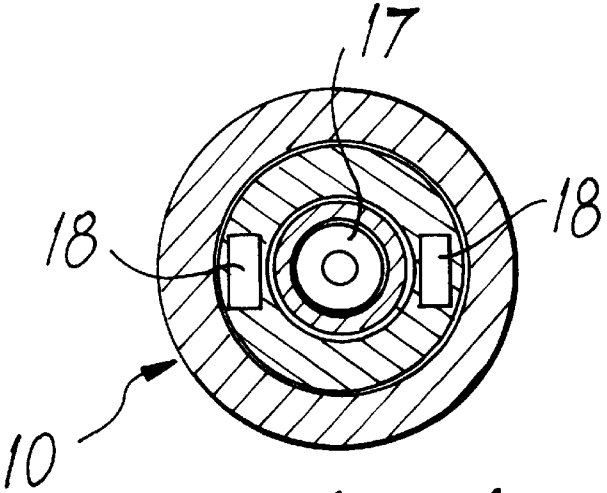
Figure 3:
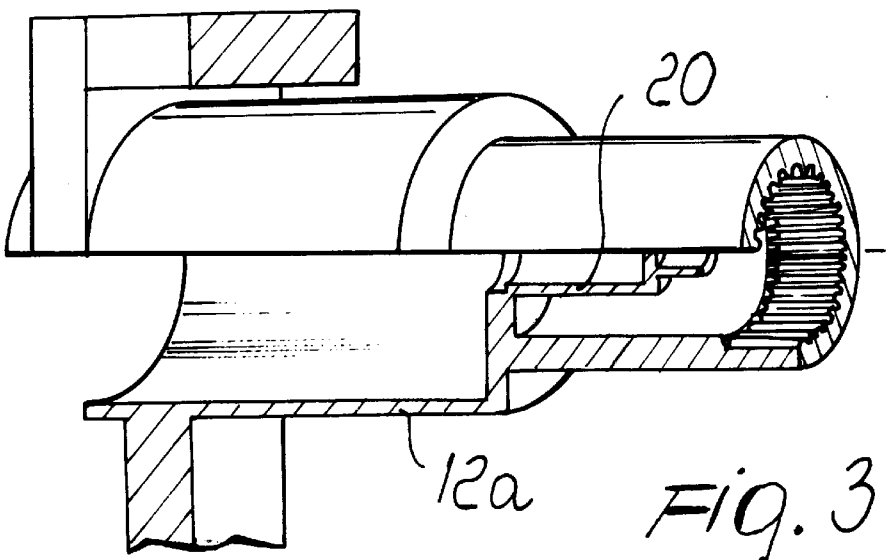
FIG. 3 is a perspective exploded view of the detail of FIG. 2.

With particular reference to FIGS. 1 to 4, a double-glazing unit provided with an actuation unit 10 according to the invention is generally designated by the reference numeral 11 in a first embodiment.

The double-glazing unit 11 comprises a perimetric frame 12 which supports, in this case, two parallel glass panes 13, only one whereof is shown in the figures. The panes form between them a hermetic air space 14 which accommodates light-blocking means which in this case are constituted by a Venetian blind, generally designated by the reference numeral 15.

The blind 15 is moved from a fully packed condition to an opened-out condition and viceversa by means for generating a rotary motion, which are constituted in this case by an electric motor 16 which is part of the unit 10, as described in greater detail hereinafter.

The unit 10 is accommodated in a contoured hollow element 12*a* which replaces a corner region of the frame 12 and comprises, in this embodiment, a magnetic kinematic coupling device, which is constituted by a first (central) permanent magnet 17 which is tubular, has an axial polarization and extension and is connected so as to rotate with the shaft of the motor 16.

In particular, the shaft of the motor 16 can be extracted from the first magnet 17, ensuring quick and easy replacement of the motor 16 in case of fault.

The magnetic device further comprises two second permanent magnets (satellite magnets) 18 arranged symmetrically, mutually opposite with respect to the first permanent magnet 17 and having an extension and polarization which are axial, parallel and similar to those of the first magnet 17.

In particular, the second permanent magnets 18 are suitable to rotate, in relation to the rotation of the first permanent magnet 17, about the first permanent magnet 17 due to the closure of radial field lines.

In this case, the second permanent magnets 18 are mutually rigidly connected to a multistage epicyclic reduction unit of a per se known type, which is generally designated by the reference numeral 19 and is suitable to transmit the geared-down motion to the shaft 21 on which the wires 22, from which the lower end of the Venetian blind 14 is suspended, are wound.

Moreover, in this embodiment the first permanent magnet 17 is external to the air space 14 and is contained in a capsule 20 for dielectric separation with respect to the second permanent magnets 18.

Figure 5:
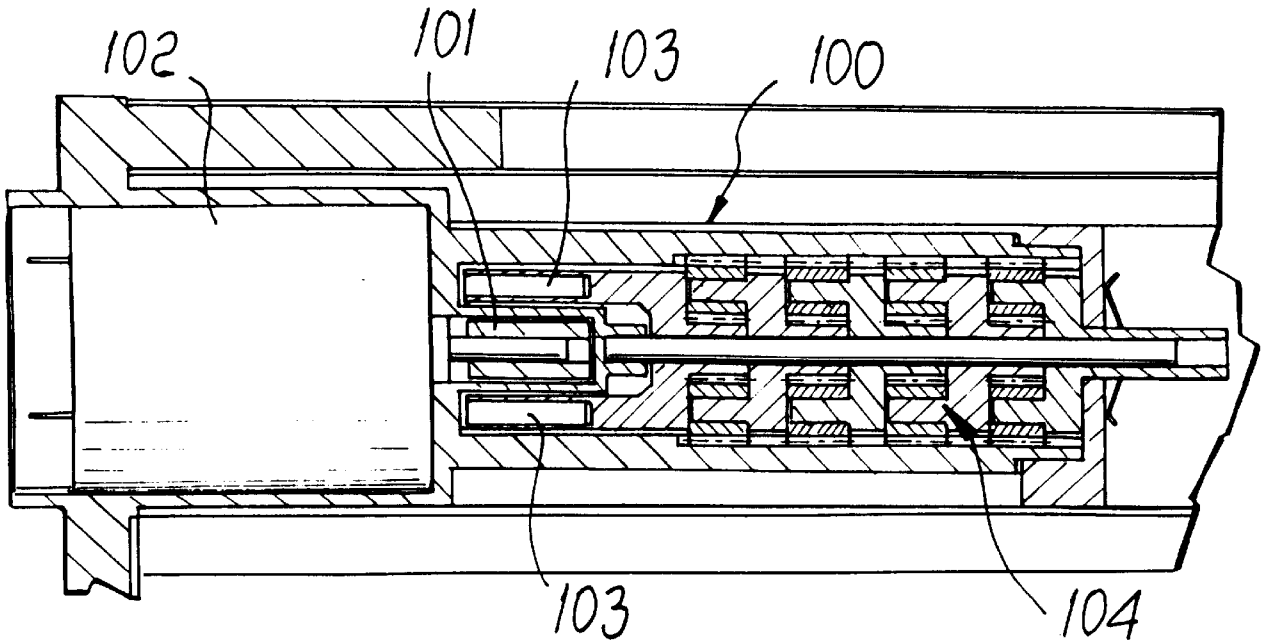
FIG. 5 is a sectional view of part of a unit according to the invention in a second embodiment.
Figure 6:
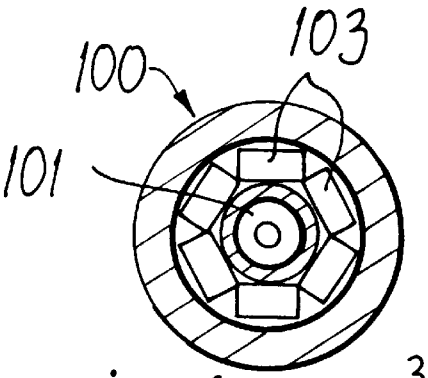
FIG. 6 is another sectional view of the detail of FIG. 5.

With particular reference to FIGS. 5 and 6, an actuation unit according to the invention, in a second embodiment, is fully similar to the unit 10, except for the kinematic connection device, generally designated by the reference numeral 100, with which it is provided.

In this case, the device 100 comprises a first (central) permanent magnet 101, which is also connected to the motor means 102, and a plurality of second (satellite) permanent magnets 103, which are mutually opposite in pairs and rotate in relation to the rotation of the first permanent magnet 101 owing to the closure of radial field lines.

The second permanent magnets 103, in this case too, are associated with an epicyclic reduction unit of a per se known type, generally designated by the reference numeral 104.

Figure 7:
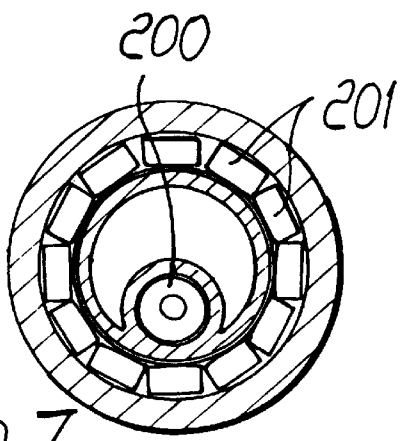
FIG. 7 is a view of a different embodiment of the detail of FIG. 5.

With particular reference to FIG. 7, in a different embodiment of the device 100 the first permanent magnet, designated by the reference numeral 200 in this case, is indeed parallel to the second permanent magnets, designated by the reference numeral 201 in this case, but is mounted eccentrically thereto; in any case, the second permanent magnets 201 are instead arranged on an ideal cylindrical surface.

This arrangement allows to reduce the rotation rate, since the first permanent magnet 200 significantly affects only the second permanent magnets 201 located proximate thereto.

Figure 8:
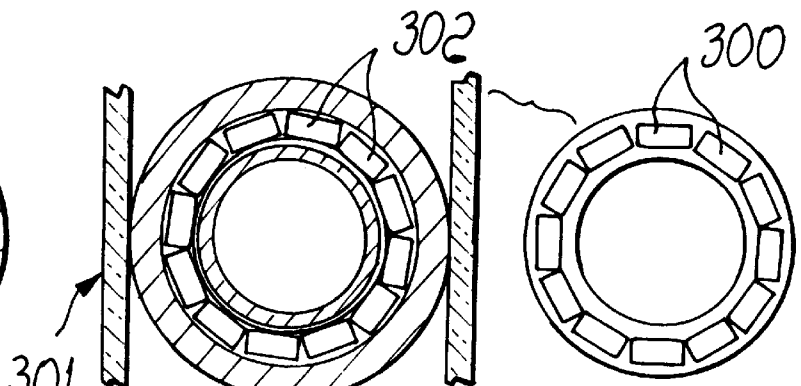
FIG. 8 is a view of a further embodiment of the detail of FIG. 5.

With particular reference to FIG. 8, in an additional different embodiment of the device 100 a plurality of first permanent magnets connected to the motor means, designated by the reference numeral 300 in this case, is external to the double-glazing unit 301 and to the second magnets, designated by the reference numeral 302 in this case, to which they remain parallel and laterally adjacent, maintaining the radial closure of the lines of force.

In practice, it has been observed that the present invention has achieved the intended aim and objects.

In particular, it should be noted that by virtue of its perfectly balanced structure, the actuation unit according to the invention requires no supporting and balancing structure, with a considerable saving in terms of bulk and flexibility in application to the most disparate types of double-glazing unit.

It should also be noted that the force that can be transmitted by the actuation unit according to the invention is particularly simple to increase, since it indeed requires a greater longitudinal extension of the magnets that constitute the coupling.

Besides, longitudinal bulk is highly less troublesome and more available than radial bulk, in view of the similar characteristics, in terms of longitudinal extension, of the seats formed in the frame of the double-glazing unit.

It should also be noted that the actuation unit according to the invention is suitable to reduce the rotation rate, without altering the effectiveness and structural balance characteristics.

It should also be noted that the electric motor can conveniently be replaced with another suitable motorization and even by a crank or other manual actuation device.

Figure 9:
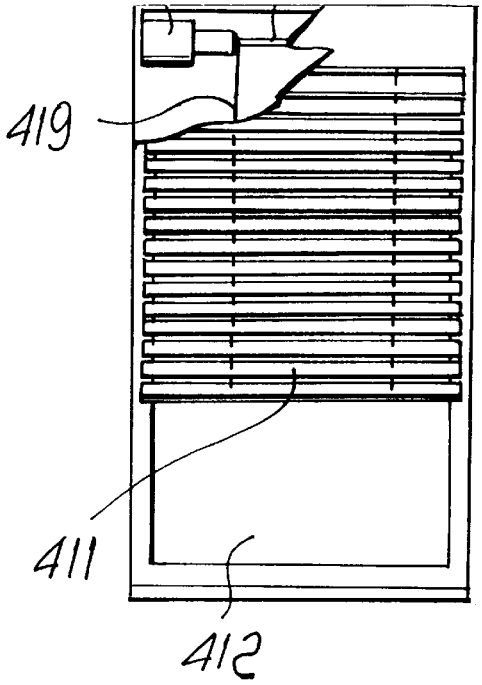
FIGS. 9 and 10 are views of a still further embodiment which is related in this case to window-mounting.
Figure 10:
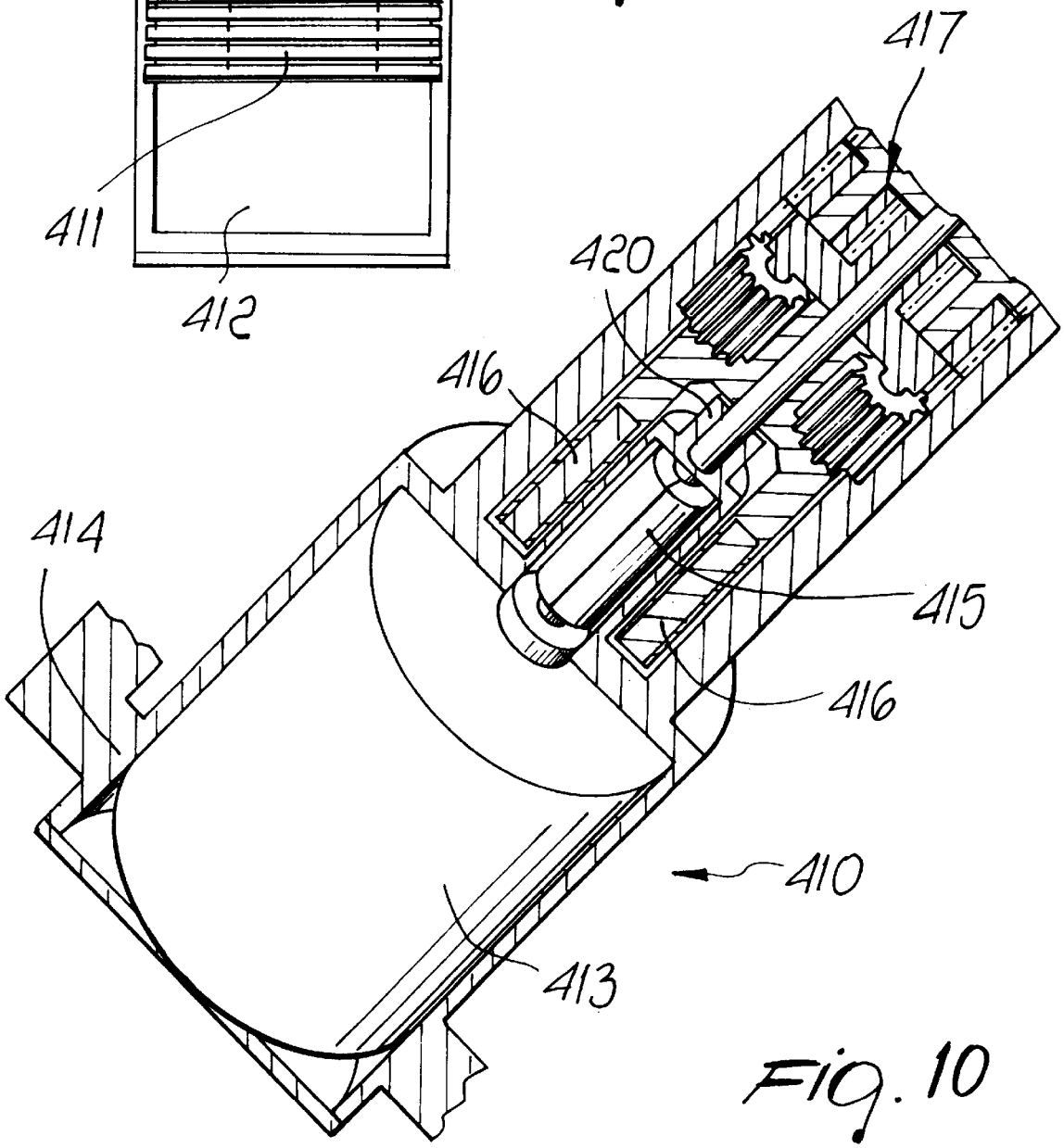

With particular reference to FIGS. 9 and 10, an actuation unit according to the invention, in another embodiment, moves light-blocking means which, in this case, are constituted by a Venetian blind 411 fixed to a window 412.

The blind 411 is again moved from a fully-packed condition to an opened-out condition and viceversa by means for generating a rotary motion which are constituted, in this case too, by an electric motor 413 which is part of the unit, now designated by the reference numeral 410.

The unit 410, in this particular embodiment, is accommodated in a contoured hollow element 414 comprising a magnetic kinematic coupling device which is constituted by a first (central) permanent magnet 415, which is tubular, has an axial extension and polarization, and is connected so as to rotate with the shaft of the motor 413.

In particular, the shaft of the motor 413 can be extracted from the first magnet 415, ensuring, in case of fault, quick and easy replacement of the motor 413.

The magnetic device also comprises two second permanent magnets (satellite magnets) 416 arranged symmetrically and mutually opposite with respect to the first permanent magnet 415 and having an extension and a polarization which are axial, parallel and similar to the first permanent magnet.

In particular, the second permanent magnets 416 are suitable to rotate, in relation to the rotation of the first permanent magnet 415, about the first permanent magnet 415 by virtue of the closure of radial field lines.

In this case, the second permanent magnets 416 are mutually rigidly coupled to a multistage epicyclic reduction unit of a per se known type, generally designated by the reference numeral 417, which is suitable to transmit the geared-down motion to the shaft 418 on which the wires 419, from which the lower end of the Venetian blind 411 is suspended, are wrapped.

Moreover, in this embodiment the first permanent magnet 415 is contained in a capsule 420 for dielectric separation with respect to the second permanent magnets 416.

Variations for window-mounting, equivalent to those for mounting in double-glazing units, are provided.

In this window-specific case too, it should be noted that the actuation unit described with the present invention requires no supporting structure and has a reduced bulk and considerable flexibility in application to the most disparate blind types.

The present invention is susceptible of numerous modifications and variations, all of which are within the scope of the inventive concept.

The details may be replaced with other technically equivalent elements; the materials and the dimensions may be any according to requirements.

What is claimed is:

1. An actuation unit connected with light blocking means movably arranged between a rolled-up condition and an opened-out condition in a hermetic air space of a double-glazing unit having a pair of glass panes between which said hermetic air space is formed, said actuation unit comprising a magnetic kinematic coupling device connected with means for generating a rotary motion and with kinematic systems for moving said light blocking means, said magnetic kinematic coupling device comprising at least one first permanent magnet which is arranged outside said hermetic air space and which is connected in rotation with a shaft of said means for generating a rotary motion, and at least one second permanent magnet arranged adjacent said first permanent magnet and having a polarization extending parallel to the polarization extension of said first magnet such that said second permanent magnet rotates in relation to the rotation of said first magnet in response to a closure of radial field lines, said at least one second permanent magnet being connected to a shaft of said kinematic systems for moving said light blocking means arranged inside said hermetic air space for rotation of said shaft of said kinematic systems for moving said light blocking means dependent upon the rotation of said at least one first permanent magnet.

2. The actuation unit connected with the light blocking means in the double-glazing unit according to claim 1, comprising at least two second magnets which rotate about said first magnet.

3. The actuation unit connected with the light blocking means in the double-glazing unit according to claim 2, wherein said at least one first magnet is encapsulated with respect to said two second magnets by means of a dielectric separation capsule.

4. The actuation unit connected with the light blocking means in the double-glazing unit according to claim 2, wherein said at least one first permanent magnet has an axial extension and polarization, said at least two second permanent magnets having an axial extension and polarization which are parallel to said first magnet.

5. The actuation unit connected with the light blocking means in the double-glazing unit according to claim 2, wherein said at least one first magnet is arranged in a position which is axially symmetrical with respect to said at least two second permanent magnets.

6. The actuation unit connected with the light blocking means in the double-glazing unit according to claim 1, wherein said magnetic kinematic coupling device comprises a plurality of second magnets, which are arranged substantially equidistant cylindrically about said first magnet, said first magnet being arranged in an axially symmetrical position in said magnetic kinematic coupling device.

7. The actuation unit connected with the light blocking means in the double-glazing unit according to claim 1, wherein said magnetic kinematic coupling device comprises a plurality of second permanent magnets arranged equidistant cylindrically about a central axis, said at least one first permanent magnet being arranged axially parallel and internally and eccentrically with respect to the central axis of said second magnets.

8. The actuation unit connected with the light blocking means in the double-glazing unit according to claim 3, wherein said second permanent magnets are rigidly coupled to a speed reduction unit.

9. The actuation unit connected with the light blocking means in the double-glazing unit according to claim 8, wherein said speed reduction unit is an epicyclic reduction unit.

10. The actuation unit connected with the light blocking means in the double-glazing unit according to claim 1, wherein said means for generating a rotary motion comprises an electric motor which is arranged outside said hermetic air space removably connected with said at least one first magnet.

11. The actuation unit connected with the light blocking means in the double-glazing unit according to claim 10, wherein said electric motor comprises said shaft of said means for generating a rotary motion which is extractably connected inside said at least one first magnet.

12. The actuation unit connected with the light blocking means in the double-glazing unit according to claim 9, wherein said epicyclic reduction unit is connected to the shaft of said kinematic systems for moving said light blocking means on which flexible elements wind, the lower end of said light-blocking means being suspended from said flexible elements.

13. The actuation unit connected with the light blocking means in the double-glazing unit according to claim 1, wherein one of the glass panes of said double-glazing unit is interposed between said at least one first permanent magnet and said at least one second magnet, said at least one first magnet being arranged parallel and laterally adjacent to said at least one second magnet for maintaining the closure of the radial field lines.

14. The actuation unit connected with the light blocking means in the double-glazing unit according to claim 1, wherein said magnetic kinematic coupling unit is accommodated in a contoured hollow element.

15. The actuation unit connected with the light blocking means in the double-glazing unit according to claim 14, wherein said contoured hollow element forms a corner region of a frame of said double-glazing unit.

* * * * *